US010741970B1

(12) United States Patent
Liu

(10) Patent No.: US 10,741,970 B1
(45) Date of Patent: Aug. 11, 2020

(54) ELECTRICAL CONNECTOR AND ELECTRICAL CONNECTOR ASSEMBLY HAVING THE SAME

(71) Applicant: Hao Liu, Suzhou (CN)

(72) Inventor: Hao Liu, Suzhou (CN)

( * ) Notice: Subject to any disclaimer, the term of this patent is extended or adjusted under 35 U.S.C. 154(b) by 0 days.

(21) Appl. No.: 16/503,632

(22) Filed: Jul. 5, 2019

(51) Int. Cl.

| | |
|---|---|
| ***H01R 13/64*** | (2006.01) |
| ***H01R 13/506*** | (2006.01) |
| ***H01R 13/66*** | (2006.01) |
| ***H01R 13/631*** | (2006.01) |

(52) U.S. Cl.
CPC ..... *H01R 13/64* (2013.01); *H01R 13/506* (2013.01); *H01R 13/631* (2013.01); *H01R 13/665* (2013.01)

(58) Field of Classification Search
CPC .... H01R 13/64; H01R 13/506; H01R 13/631; H01R 13/665; H01R 13/62; H01R 13/629; H01R 13/6271; H01R 13/6272; H01R 13/6275; H01R 12/7005; H01R 12/7023; H01R 12/7029
USPC ..... 439/374, 345, 354, 358
See application file for complete search history.

(56) References Cited

U.S. PATENT DOCUMENTS

| | | | | |
|---|---|---|---|---|
| 7,226,314 | B2 * | 6/2007 | Lang | H01R 13/629 439/607.04 |
| 7,572,138 | B1 * | 8/2009 | Wu | H01R 13/6275 439/352 |
| 8,439,706 | B2 * | 5/2013 | Sytsma | H01R 13/65802 439/607.46 |
| 10,381,779 | B2 * | 8/2019 | Zhou | H01R 12/79 |
| 10,439,309 | B2 * | 10/2019 | Ju | H01R 13/113 |
| 2011/0003493 | A1 * | 1/2011 | Mo | H01R 27/00 439/81 |
| 2012/0156900 | A1 * | 6/2012 | Wu | H01R 13/504 439/76.1 |
| 2016/0149346 | A1 * | 5/2016 | Hsu | H01R 13/6581 439/607.01 |

* cited by examiner

*Primary Examiner* — Travis S Chambers
(74) *Attorney, Agent, or Firm* — Cheng-Ju Chiang

(57) ABSTRACT

An electrical connector comprises an insulative housing, a printed circuit board retained in the insulative housing, and a limiting member. The insulative housing has a mating portion and a main portion extending backwards from the mating portion. The printed circuit board has a tongue portion exposed in front of the mating portion and a plurality of golden fingers disposed on the tongue portion for mating with a complementary connector. The limiting member defines a pair of first limiting plates parallel and opposite to each other. The first limiting plates are located in front of the mating portion entirely and on both sides of the tongue portion in a transverse direction, a first guiding slot is formed between each first limiting plate and corresponding lateral surface of the tongue portion in the transverse direction for leading the complementary connector to be plugged.

17 Claims, 16 Drawing Sheets

ELECTRICAL CONNECTOR AND ELECTRICAL CONNECTOR ASSEMBLY HAVING THE SAME

BACKGROUND OF THE INVENTION

1. Field of the Invention

The present invention relates to an electrical connector and an electrical connector assembly having the same, and more particularly to an electrical connector mating with a complementary connector precisely and an electrical connector assembly having the same.

2. Description of Related Art

Electrical connectors are indispensable components in electronic devices, with the upgrading of the electronic devices, electrical connectors have been developed into quite mature products. For an electrical connector, it is necessary to be able to transmit signal or current in a stable, reliable, and high-speed manner. Generally speaking, an electrical connector assembly generally includes a plug connector and a receptacle connector mating with each other, the plug connector defines a circuit board, an insulative housing and a cable. The circuit board includes an inserting end which protrudes out of the insulative housing, an upper surface and a lower surface of the inserting end are provided with metal contact fingers connected to the cable for mating with receptacle contacts of the receptacle connector. However, while an installation space of the electrical connector assembly in an electrical device is limited and a size of the plug connector is made to be smaller, the plug connector is easy to be inserted obliquely due to a stress from the cable, and then the circuit board may be abutting against the receptacle contacts, and a risk of collapse of the receptacle contacts may be difficult to avoid.

Hence, it is desired to provide an electrical connector and an electrical connector assembly to overcome the problems mentioned above.

BRIEF SUMMARY OF THE INVENTION

Accordingly, an object of the present invention is to provide an electrical connector and an electrical connector assembly, and a printed circuit board of the electrical connector can be prevented from damaging contacting portions of a complementary connector.

The present invention is directed to an electrical connector comprising an insulative housing, a printed circuit board retained in the insulative housing, and a limiting member. The insulative housing has a mating portion and a main portion extending backwards from the mating portion. The printed circuit board has a tongue portion exposed in front of the mating portion and a plurality of golden fingers disposed on the tongue portion for mating with a complementary connector. The limiting member defines a pair of first limiting plates parallel and opposite to each other. The first limiting plates are located in front of the mating portion entirely and on both sides of the tongue portion in a transverse direction, a first guiding slot is formed between each first limiting plate and corresponding lateral surface of the tongue portion in the transverse direction for leading the complementary connector to be plugged.

An electrical connector assembly comprises an electrical connector and a complementary connector adapted to be mounted to an external circuit board. The electrical connector includes an insulative housing, a printed circuit board and a limiting member, the insulative housing has a mating portion and a main portion extending backwards from the mating portion, the printed circuit board defines a tongue portion exposed in front of the mating portion and a plurality of golden fingers disposed on the tongue portion, the limiting member has a pair of first limiting plates opposite to each other. The complementary connector is mating with the golden fingers of the electrical connector. The first limiting plates are located in front of the mating portion entirely and on both sides of the tongue portion in a transverse direction, a first guiding slot is formed between each first limiting plate and corresponding lateral surface of the tongue portion in the transverse direction for leading the complementary connector to be plugged.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
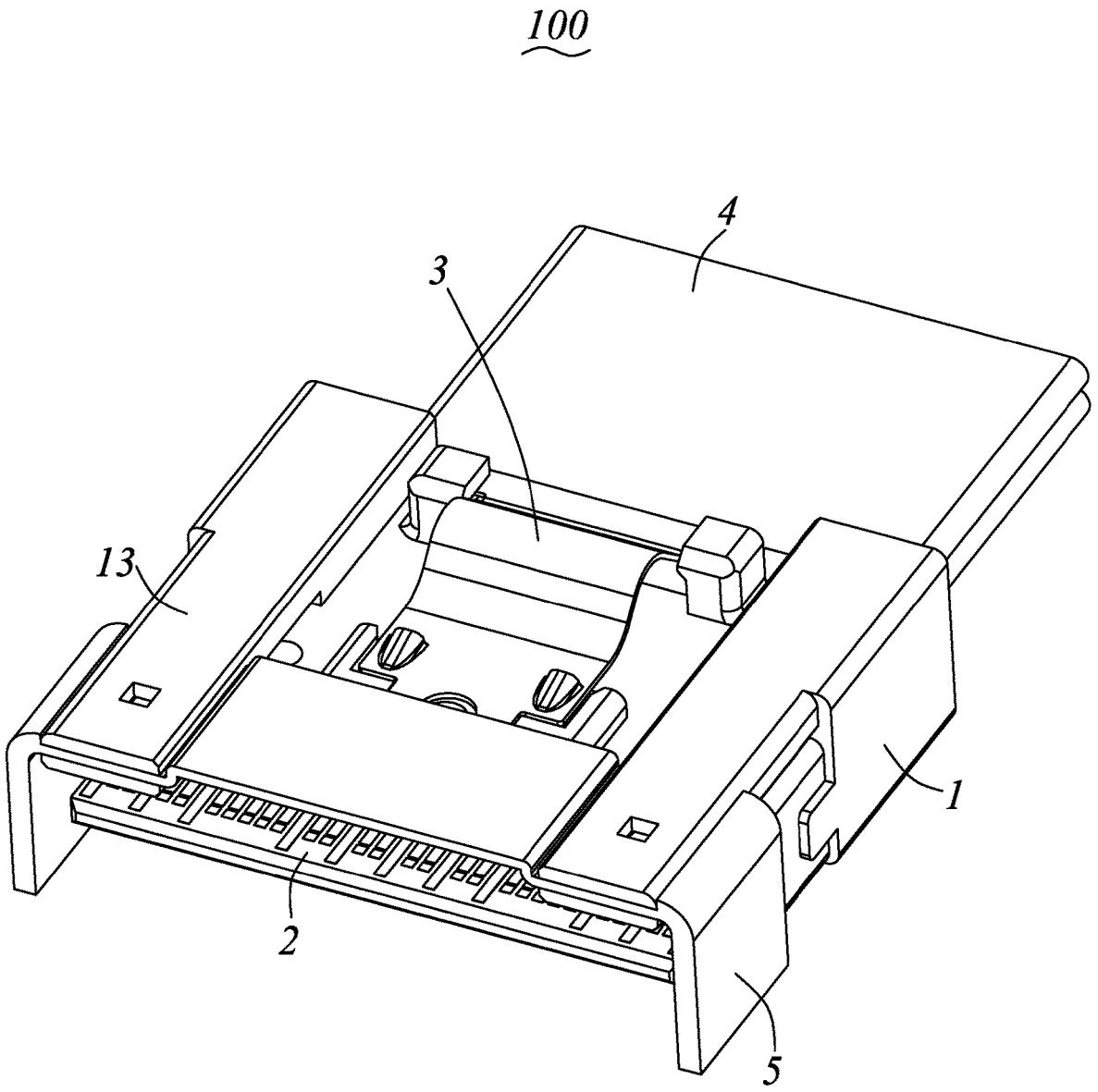
FIG. 1 is an assembled perspective view of an electrical connector in accordance with a first embodiment of the present invention.
Figure 2:
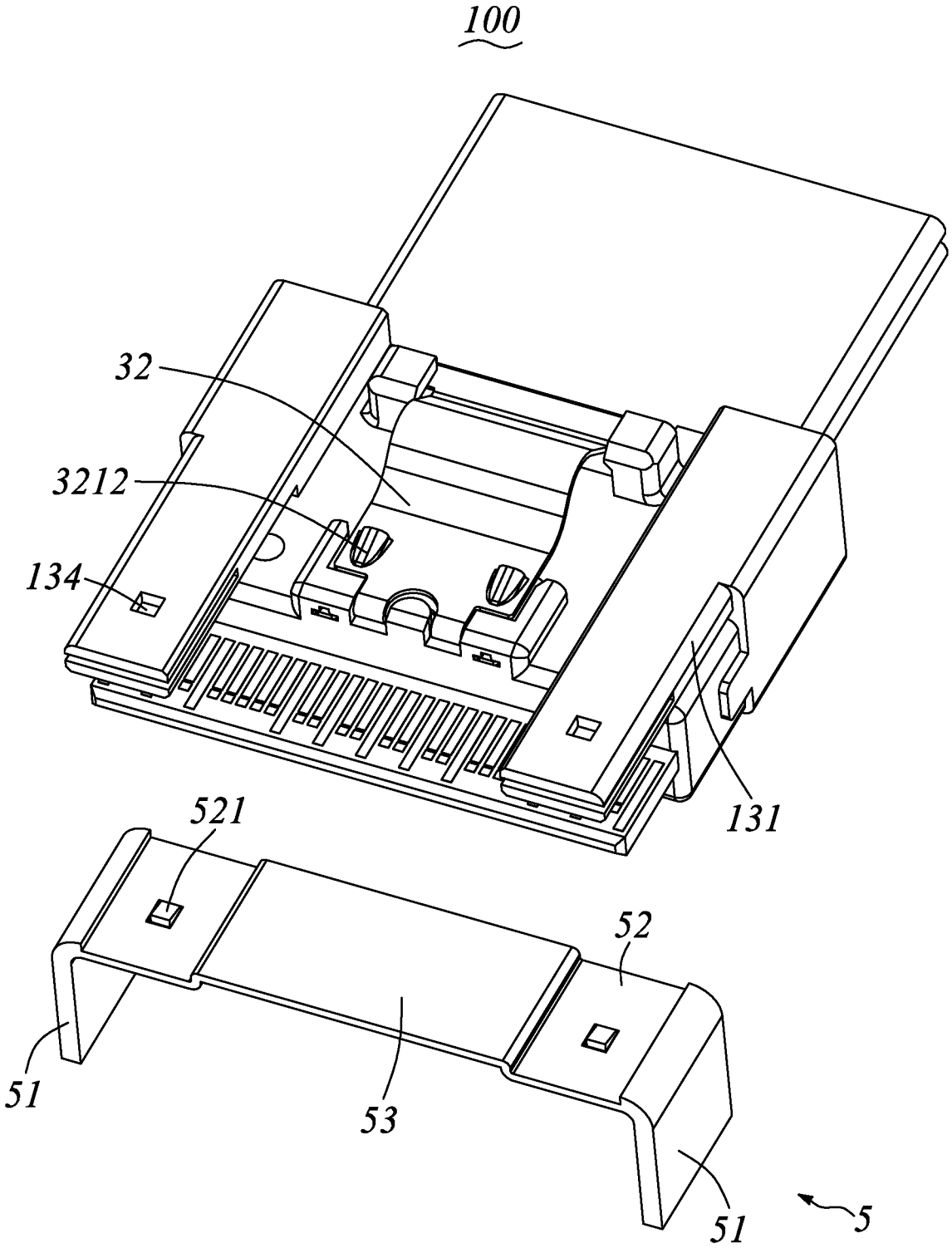
FIG. 2 is a partial exploded view of the electrical connector shown in FIG. 1.
Figure 3:
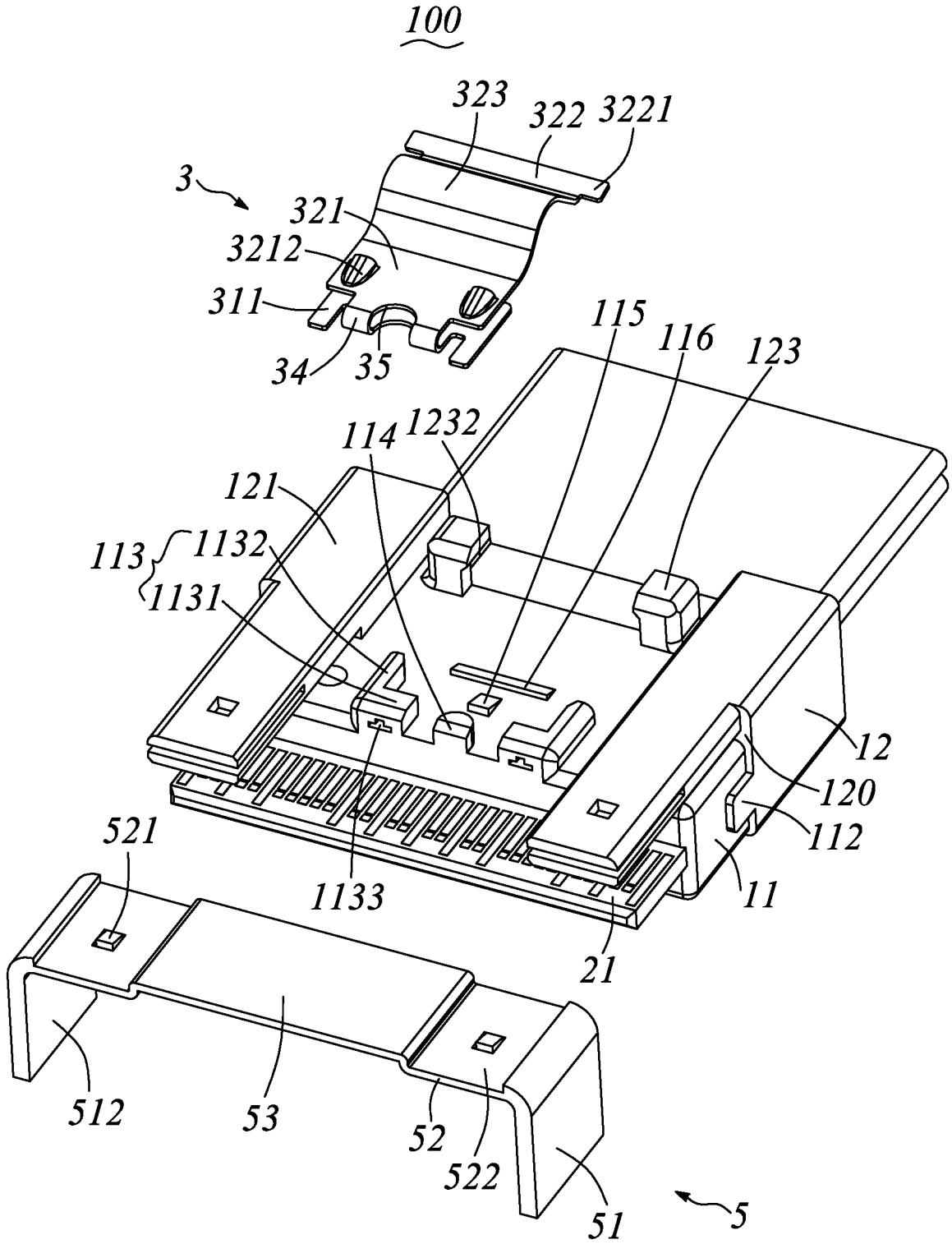
FIGS. 3 and 4 are further exploded views of the electrical connector shown in FIG. 2.
Figure 4:
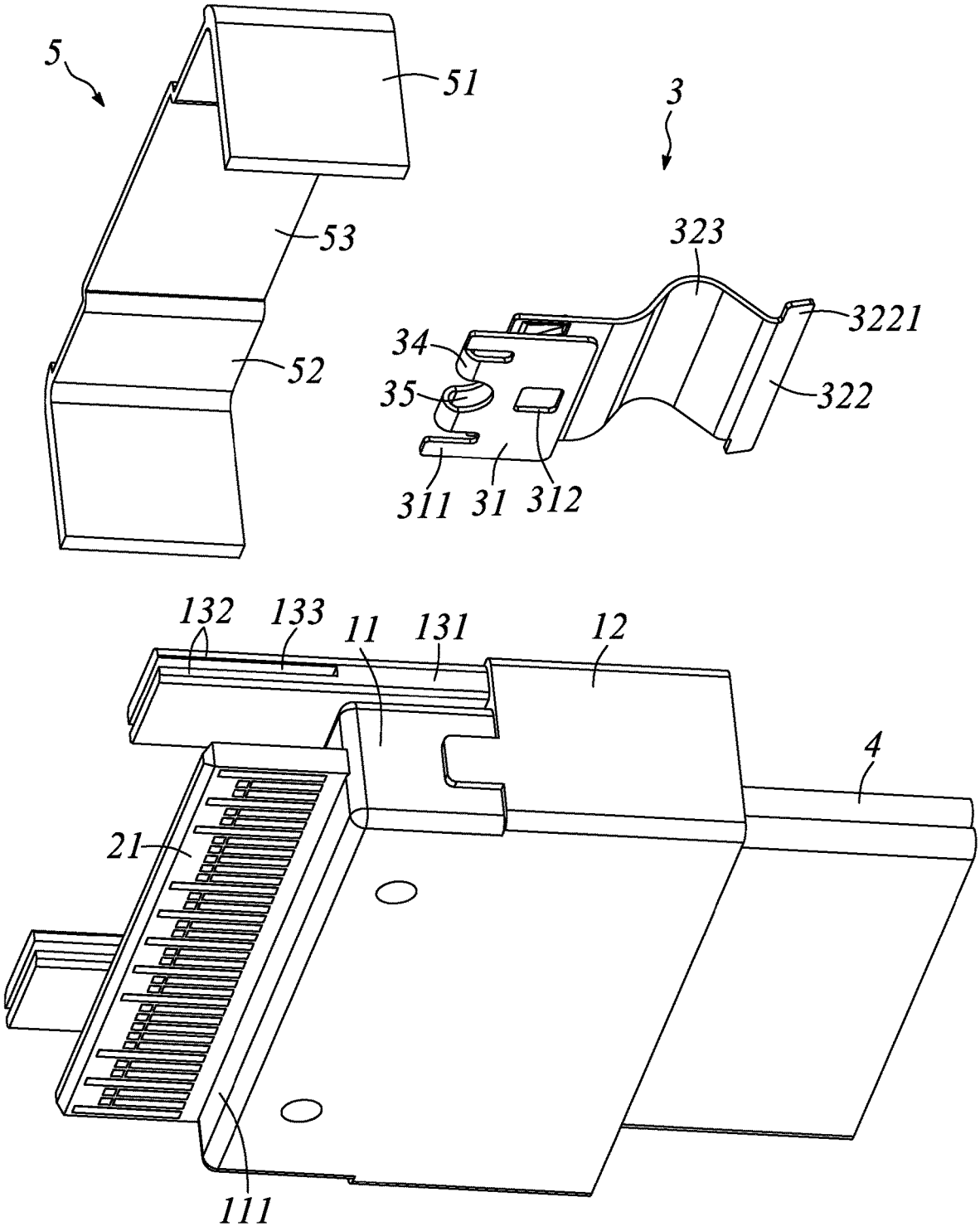
Figure 5:
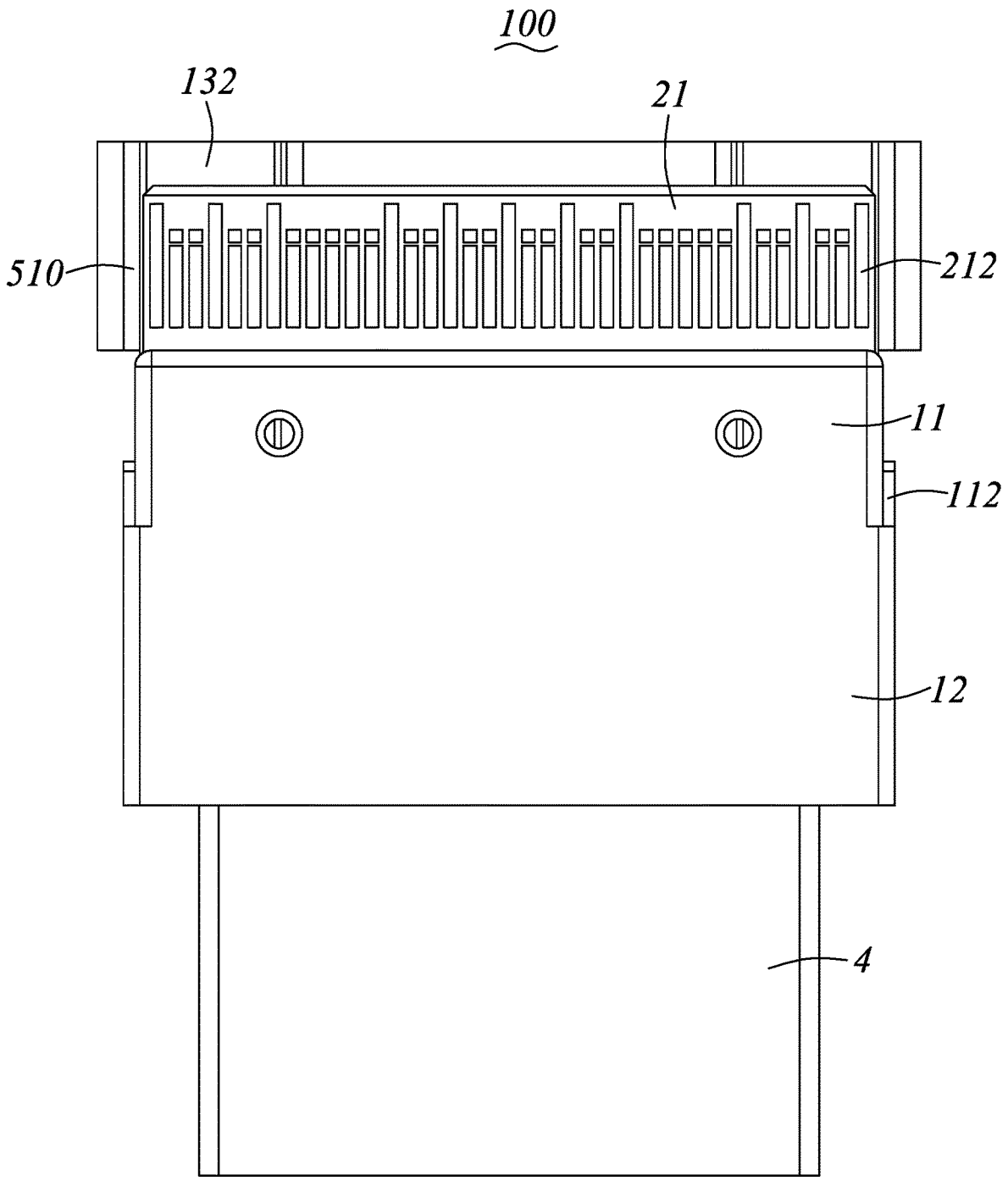
FIG. 5 is a bottom view of the electrical connector shown in FIG. 1.
Figure 6:
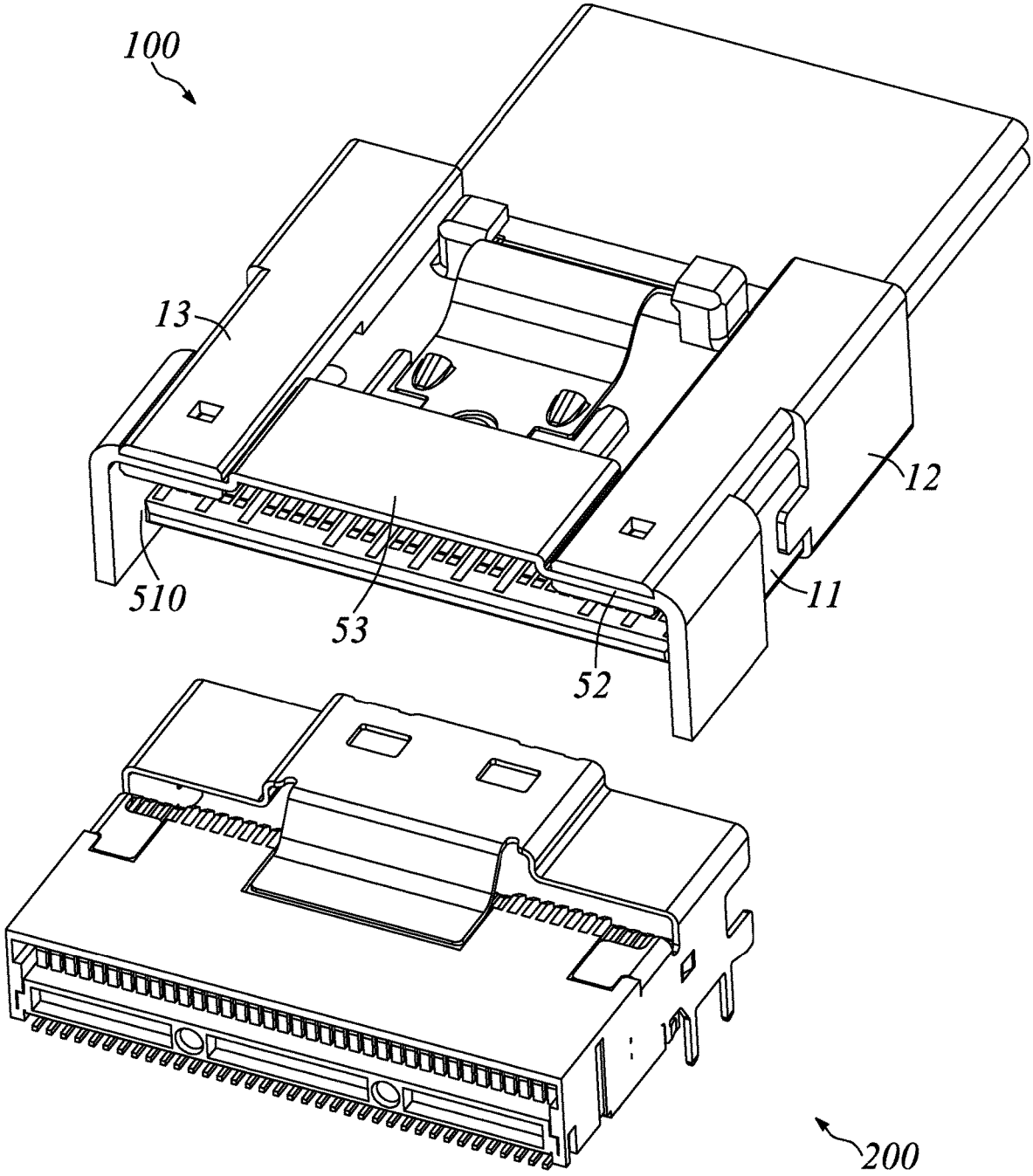
FIG. 6 is a perspective view of the electrical connector and a complementary connector when not mating.
Figure 7:
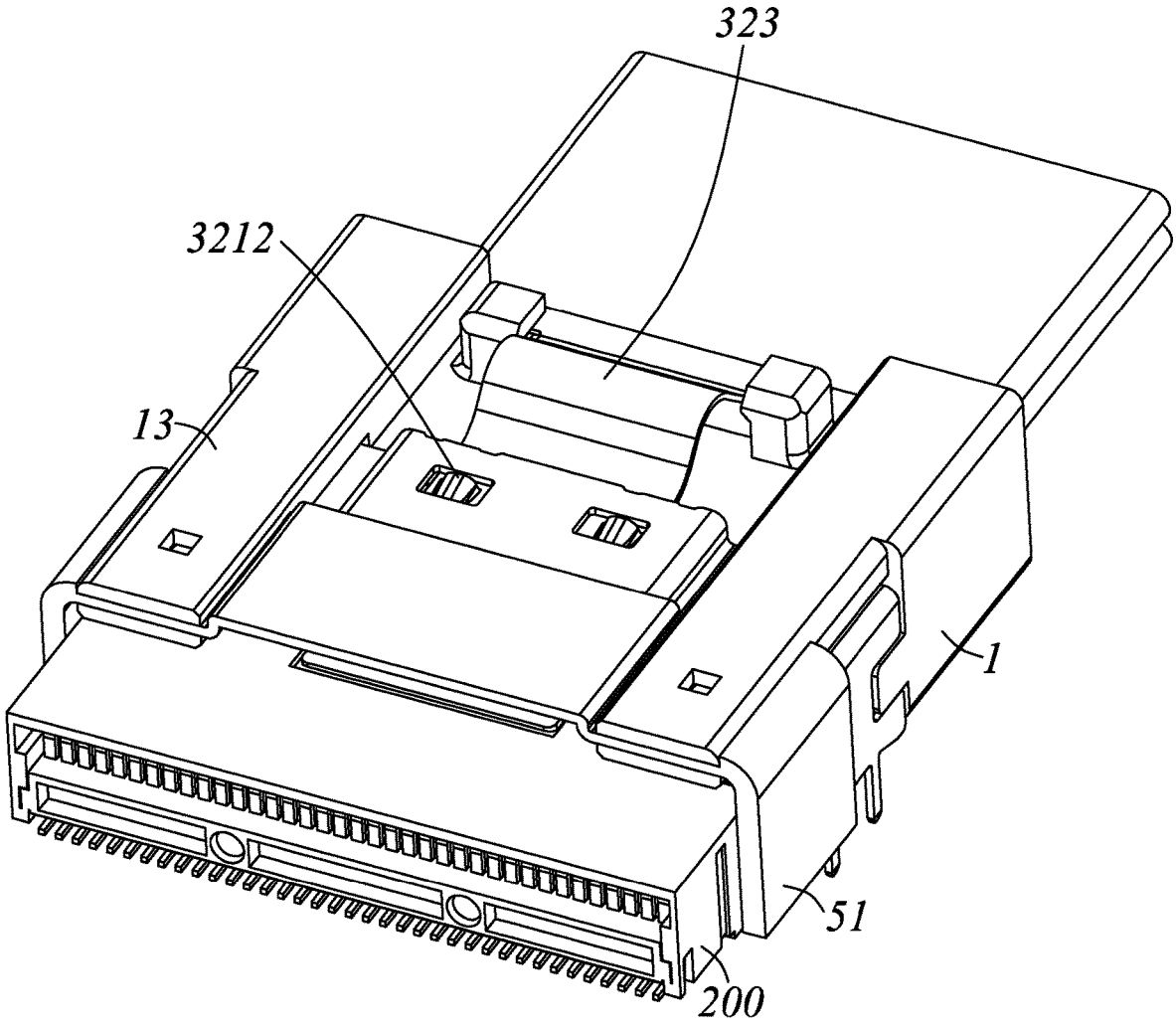
FIG. 7 is a perspective view of the electrical connector and the complementary connector as mating.
Figure 8:
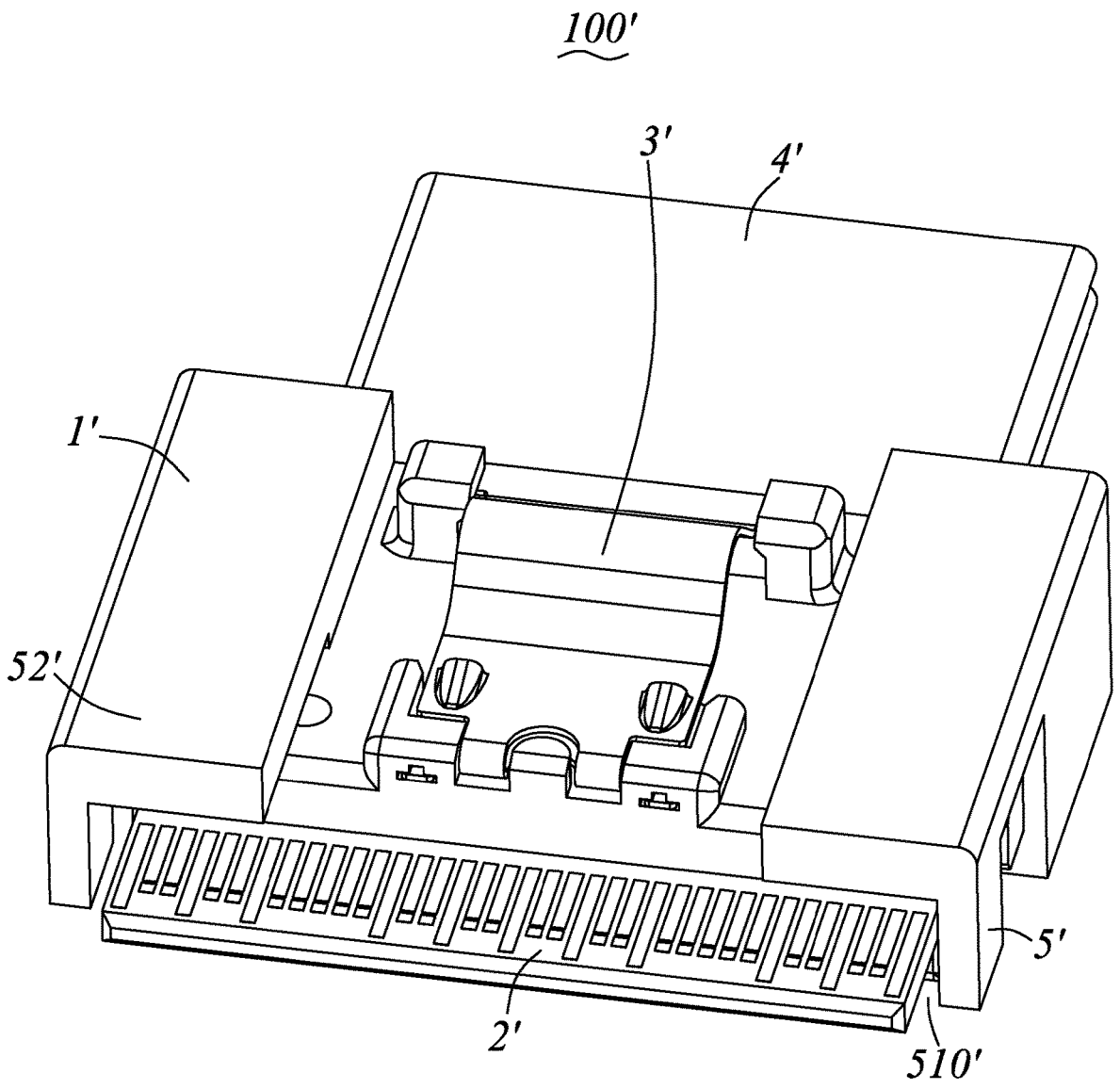
FIG. 8 is an assembled perspective view of an electrical connector in accordance with a second embodiment of the present invention.
Figure 9:
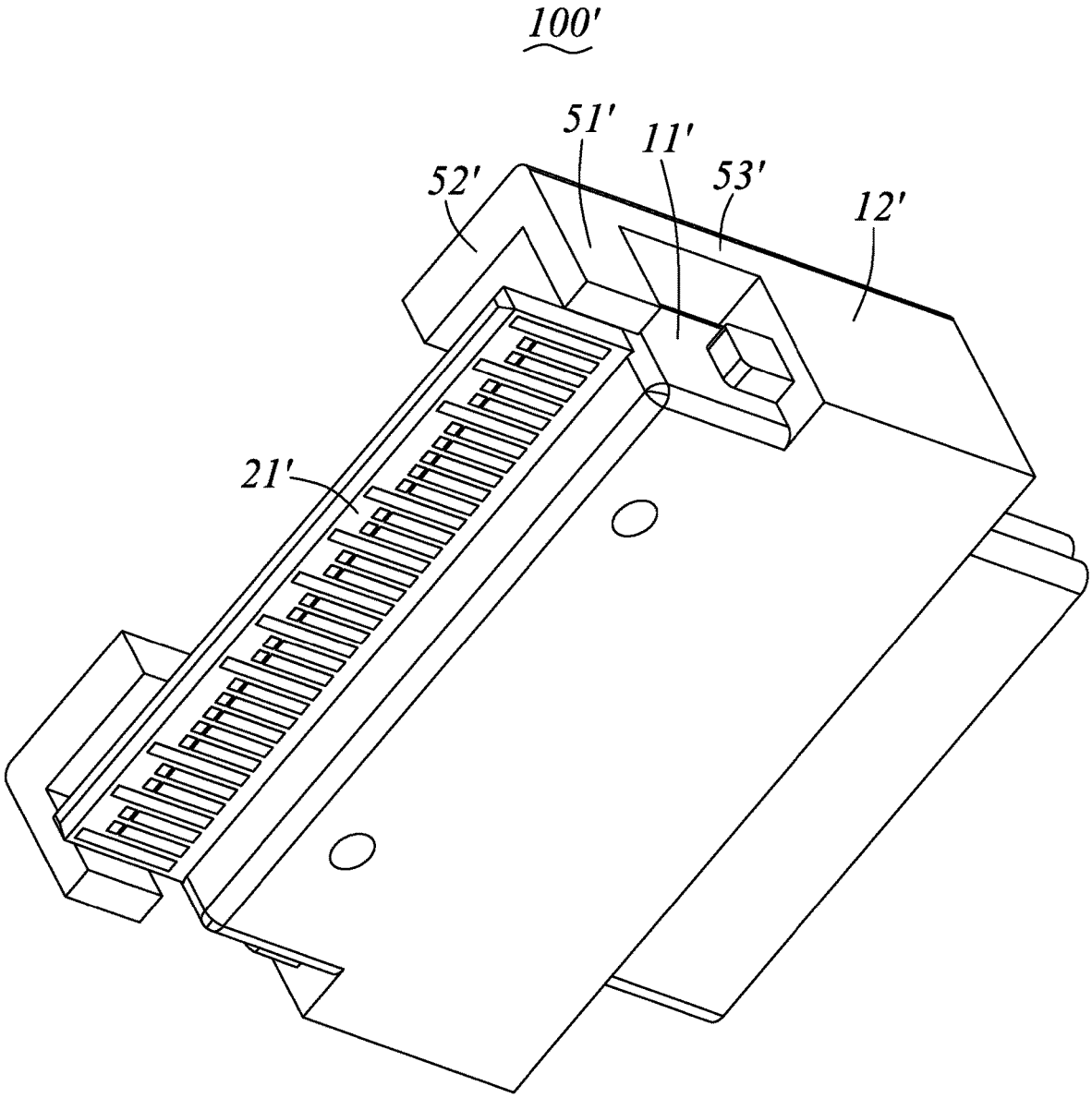
FIGS. 9 to 11 are similar to FIG. 8, but shown from different aspects.
Figure 10:
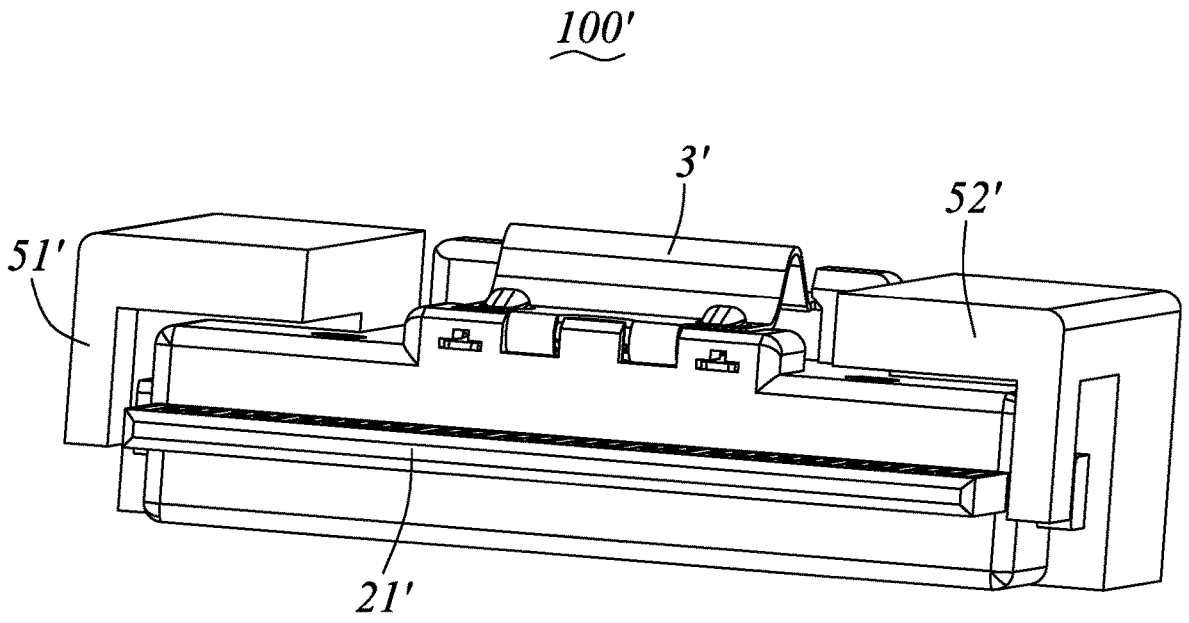

In order to make the objects, technical solutions, and advantages according to the present invention clearer, the present invention will be described in detail below with reference to the specific embodiments and drawings.

Please refer to FIG. 1 to FIG. 7, showing an electrical connector 100 according to a first embodiment of present invention, the electrical connector 100 comprises an insulative housing 1, a printed circuit board 2, a metallic latch 3 assembled to the insulative housing 1 and a data transmission cable 4 electrically connected with the printed circuit board 2.

The insulative housing 1 has a mating portion 11 and a main portion 12 integrally extending backwards from the mating portion 11. The mating portion 11 defines a pair of protrusions 112 on opposite sides thereof and a mating face 111 in the most front thereof.

In particular, the pair of protrusions 112 are disposed on both sides of the mating portion 11 in a transverse direction. Each protrusion 112 is connecting with the main portion 12 and extending forwards from a front face 120 of the main portion 12, and in the transverse direction, an outer surface of each protrusion 112 is coplanar with an exterior surface of the corresponding main portion 12.

The mating portion 11 has a pair of mounting portions 113, a nose 114 located between the pair of mounting portions 113 and a locking tab 115 behind the nose 114. A certain distance is arranged between the nose 114 and each mounting portion 113. In this embodiment, the nose 114 and the pair of mounting portions 113 are extending backwards from the mating face 111, and each mounting portion 113 defines a transverse wall 1131 and a longitudinal wall 1132 perpendicular to the transverse wall 1131, thus viewed from a top side of the mating portion 11, each mounting portion 113 is of L-shaped, and the longitudinal wall 1132 has a smaller width in the transverse direction than a length of the transverse wall 1131 in a front-and-back direction.

An engaging hole 1133 is recessed from a back end of each transverse wall 1131, and in the illustrated embodiment as shown, each engaging hole 1133 is penetrating through the relative transverse wall 1131 along the front-and-back direction. Each engaging hole 1133 is provided with a wider section and a narrower section communicated with each other, and the wider section is below the narrower section. A slant surface (not shown) is arranged on a rear side of each engaging hole 1133.

In this embodiment, a stopping portion 116 is of strip-like shape, and disposed on the mating portion 11; in other embodiment, the stopping portion 116 also can be of other shapes, such as formed by an emboss or a number of embosses, and the stopping portion 116 also can be formed on the main portion 12.

The main portion 12 defines a pair of higher walls 121 spaced apart from each other in the transverse direction and a pair of raised portions 123 located between the higher walls 121, the higher walls 121 are protruding on an upper side of the main portion 12. The pair of raised portions 123 are behind the stopping portion 116 and separated from each other in the transverse direction to form a space therebetween. Each raised portion 123 has a receiving slot 1232 opening rearwards, and the receiving slots 1232 of the pair of raised portions 123 are opening towards each other, so the receiving slots 1232 are communicated with the space between the pair of raised portions 123.

The insulative housing 1 further comprises a pair of extension portions 13 on both sides thereof in the transverse direction, and each extension portion 13 is extending forwards from the front face 120 of the main portion 12. Each extension portion 13 has a top surface coplanar with a top surface of the main portion 12.

Each extension portion 13 is provided with a connecting portion 131 extending forwards from the main portion 12 and a pair of arms 132 extending forwards from the connecting portion 131. Each arm 132 is tabulate, two arms 132 of one extension portion 13 are opposite to each other and spaced apart from each other in a height direction to form a receiving channel 133 therebetween. A locking hole 134 is defined in at least one arm 132, in the illustrated embodiment as shown, the locking hole 134 is defined in the arm 132 on an upper side and extending through the arm 132 along the height direction.

The printed circuit board 2 is retained in the insulative housing 1, in further, the insulative housing 1 is over-molded on the printed circuit board 2 and the data transmission cable 4, and the printed circuit board 2 has a tongue portion 21 exposed in front of the mating face 111.

The extension portions 13 are located above the mating portion 11 and the tongue portion 21. In particular, the connecting portions 131 are located above and spaced apart from the mating portion 11 in the height direction, and the arms 132 is located above the tongue portion 21. Further, the arms 132 are extending forwards beyond a front tip end 210 of the tongue portion 21.

The tongue portion 21 is elongated, and a plurality of golden fingers 212 are disposed on the tongue portion 21 for mating with a complementary connector 200, thereby realizing signal transmission between the electrical connector 100 and the complementary connector 200. In further, the golden fingers 212 are defined on an upper surface and a lower surface of the tongue portion 21. The electrical connector 100 and the complementary connector 200 are constituted an electrical connector assembly.

Referring to FIGS. 1 to 4, the metallic latch 3 has a flake-like fixing plate 31 and an elastic plate 32 extending backwards from the fixing plate 31 reversely. The fixing plate 31 is provided with a pair of inserting arms 311 in the front thereof and a positioning hole 312 penetrating through thereof, a front end of each inserting arm 311 is inserted into the corresponding engaging hole 1133 of the insulative housing 1, and the locking tab 115 is retained in the positioning hole 312, therefore the fixing plate 31 is orientated on an upper side of the insulative housing 1.

The elastic plate 32 defines a front base portion 321, a rear supporting beam 322 and a pressing portion 323 located between the base portion 321 and the supporting beam 322. At least one locking bump 3212 is protruding on a top surface of the base portion 321 for latching with the complementary connector 200. The supporting beam 322 has a pair of wings 3221 on opposite sides thereof in the transverse direction. And in this embodiment, the supporting beam 322 is in a piece shape, the wings 3221 are exposed on both sides of the pressing portion 323 and inserted into the corresponding receiving slots 1232 to be retained.

The pressing portion 323 is curved and protruding upwards, and at least partially exposed on an upper side of the insulative housing 1 for being operated conveniently.

The metallic latch 3 further has a pair of elbows 34 between the pair of inserting arms 311, the elbows 34 are connected with the fixing plate 31 and the elastic plate 32. In further, the elbows 34 are connected with front ends of the fixing plate 31 and the elastic plate 32, and located in front of the fixing plate 31 and the elastic plate 32. Each elbow 34 is arched and opening backwardly. The pair of elbows 34 are spaced apart from each other in the transverse direction, and a cutout 35 is formed between the pair of elbows 34 for engaging with the nose 114.

In addition, in this embodiment of the present invention, the electrical connector 100 further has a limiting member 5 assembled to the insulative housing 1, and the limiting member 5 is provided with a pair of first limiting plates 51 on both sides of the tongue portion 21 in the transverse direction, so the tongue portion 21 is located between the first limiting plates 51 along the transverse direction, and the first limiting plates 51 shield the tongue portion 21 from corresponding sides thereof. The first limiting plates 51 are parallel and opposite to each other, and each first limiting plate 51 is extending along a direction perpendicular to the transverse direction, specifically, each first limiting plate 51 is vertical to the tongue portion 21 and extending along the height direction. A projection of the tongue portion 21 on a vertical plane is at least mostly overlapped with that of the first limiting plate 51, and the projection of the tongue portion 21 on the vertical plane is preferably located in that of the first limiting plate 51 fully.

Referring to FIG. 1 to FIG. 5, in detail, the limiting member 5 is provided with a pair of second limiting plates 52 connecting with relative first limiting plates 51, and in the illustrated embodiment as shown, a front face of the first limiting plates 51 is coplanar to a front face of the second limiting plates 52 and a front end surface of the extension portions 13, and the front face of the first limiting plates 51 is in front of the front tip end 210 of the tongue portion 21. Each second limiting plate 52 is fixed in the relative receiving channel 133 and sandwiched by the corresponding pair of arms.

In this embodiment, a material thickness of each first limiting plate 51 is not be less than that of each second limiting plate 52, specially, a thickness of each first limit plate 51 in the transverse direction is not be less than a thickness of each second limit plate 52 in the height direction.

A first guiding slot 510 is formed between a leading face 512 of each first limiting plate 51 and corresponding lateral surface of the tongue portion 21 in the transverse direction, and the leading face 512 is a planar surface parallel to the vertical plane, thus the complementary connector 200 can be mated with the electrical connector 100 without obstruction. The second limiting plates 52 are covering the upper surface of the tongue portion 21 partially, and a second guiding slot is formed between each second limiting plate 52 and the upper surface of the tongue portion 21, and the arms 132 below the second limiting plates 52 are accommodated in the second guiding slot but not completely stuffing up, thereby the complementary connector 200 also can be plugged into. The protrusions 112 are exposed between the corresponding first limiting plate 51 and the main portion 12.

In the illustrated embodiment as shown, a retaining portion 521 is arranged on each second limiting plate 52 and cooperated with the relative locking hole 134; in other embodiments, the locking hole 134 can be disposed in each second limiting plate 52, and the retaining portion 521 can be defined on one arm 132 of the insulative housing 1.

In this embodiment, a linking portion 53 is formed between the pair of second limiting plates 52 in the transverse direction, and the linking portion 53 is perpendicular to the first limiting plates 51 and parallel to the second limiting plates 52. Moreover, each second limiting plate 52 has a recessed surface 522 on a top side thereof, and the recessed surface 522 is lower than an upper surface of the linking portion 53. An upper surface of the limiting member 5 is approximately coplanar with an uppermost surface of the main portion 12, that is to say, in this embodiment, the upper surface of the linking portion 53 is coplanar with a top surface of the higher walls 121. In other embodiments, the limiting member 5 can have at least one strengthened rib (not shown) protruding on the upper surface thereof, and the upper surface of the limiting member 5 is approximately coplanar with the uppermost surface of the main portion 12.

Preferably, the limiting member 5 is made of metallic material and fully shielding the tongue portion 21 from three sides, thereby leading an insertion of the tongue portion 21 from three sides, and minimizing a risk of deformation of complementary contacts caused by abutting against from the tongue portion 21. Conjunction with FIGS. 6-7, in this embodiment, the complementary connector 200 is mounted on an external circuit board (not shown) along a direction vertical to a mating direction, that is to say, a mounting direction of the complementary connector 200 is same as the height direction.

Referring to FIGS. 8 to 11, an insulative housing 1', a printed circuit board 2', a metallic latch 3' and a data transmission cable 4' of an electrical connector 100' in the second embodiment of the present invention are similar or same as that of the first embodiment, so the description for them is omitted here for the second embodiment. The difference is as follows: A limiting member 5' is integrally formed with the insulative housing 1', and a pair of linking portions 53' are extending forwards from a main portion 12' of the insulative housing 1', a pair of second limiting plates 52' are extending forwards from front ends of relative linking portions 53', that is to say, each second limiting plate 52' are connected with the main portion 12' by one linking portion 53'.

A pair of first limiting plates 51' are extending downwards from outer sides of the relative second limiting plates 52', and in a front-and-back direction, the first limiting plates 51' are entirely located in front of a mating portion 11' and shielding a tongue portion 21' of the printed circuit board 2' from lateral sides of the tongue portion 21'.

Figure 11:
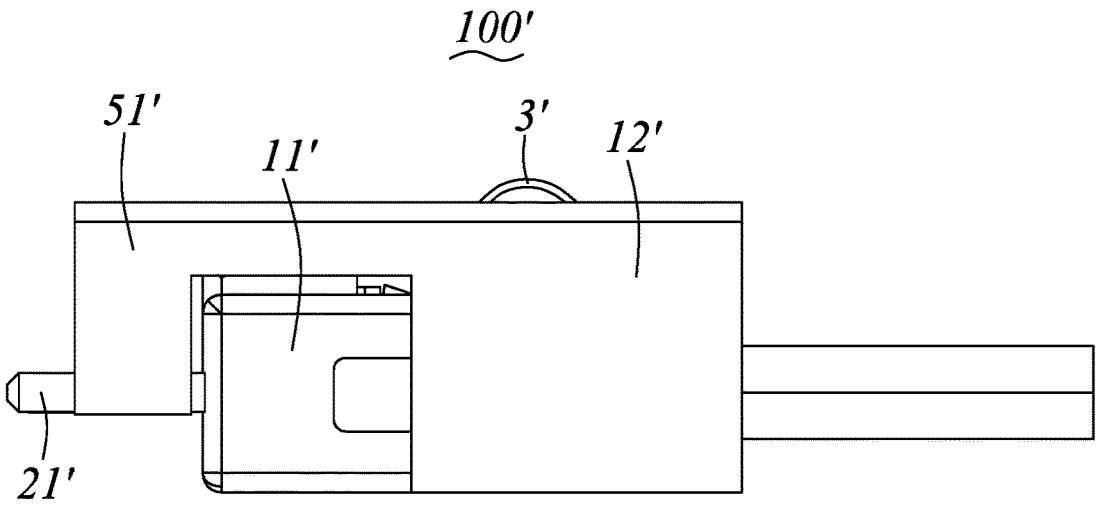
Figure 12:
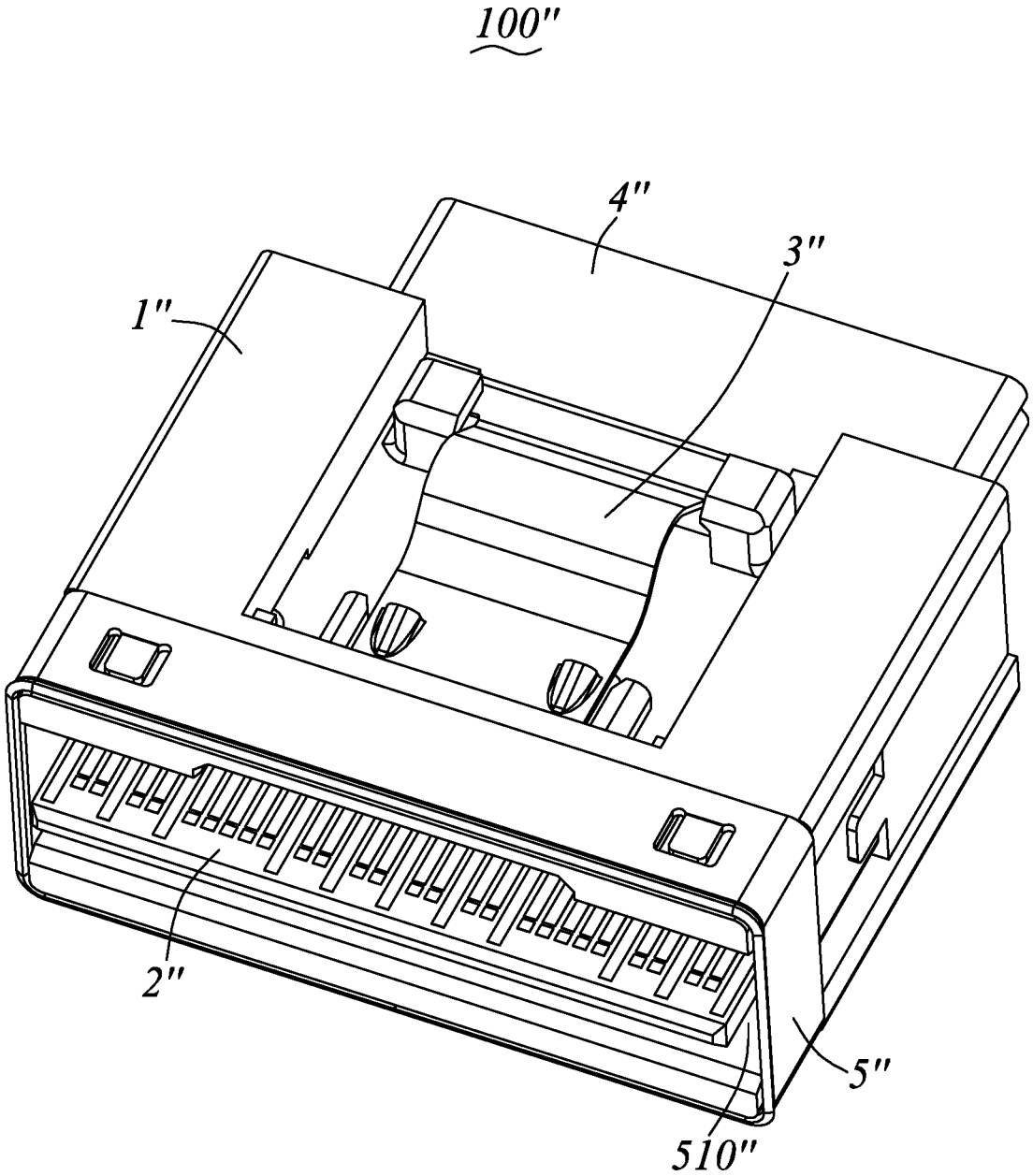
FIG. 12 is an assembled perspective view of an electrical connector in accordance with a third embodiment of the present invention.
Figure 13:
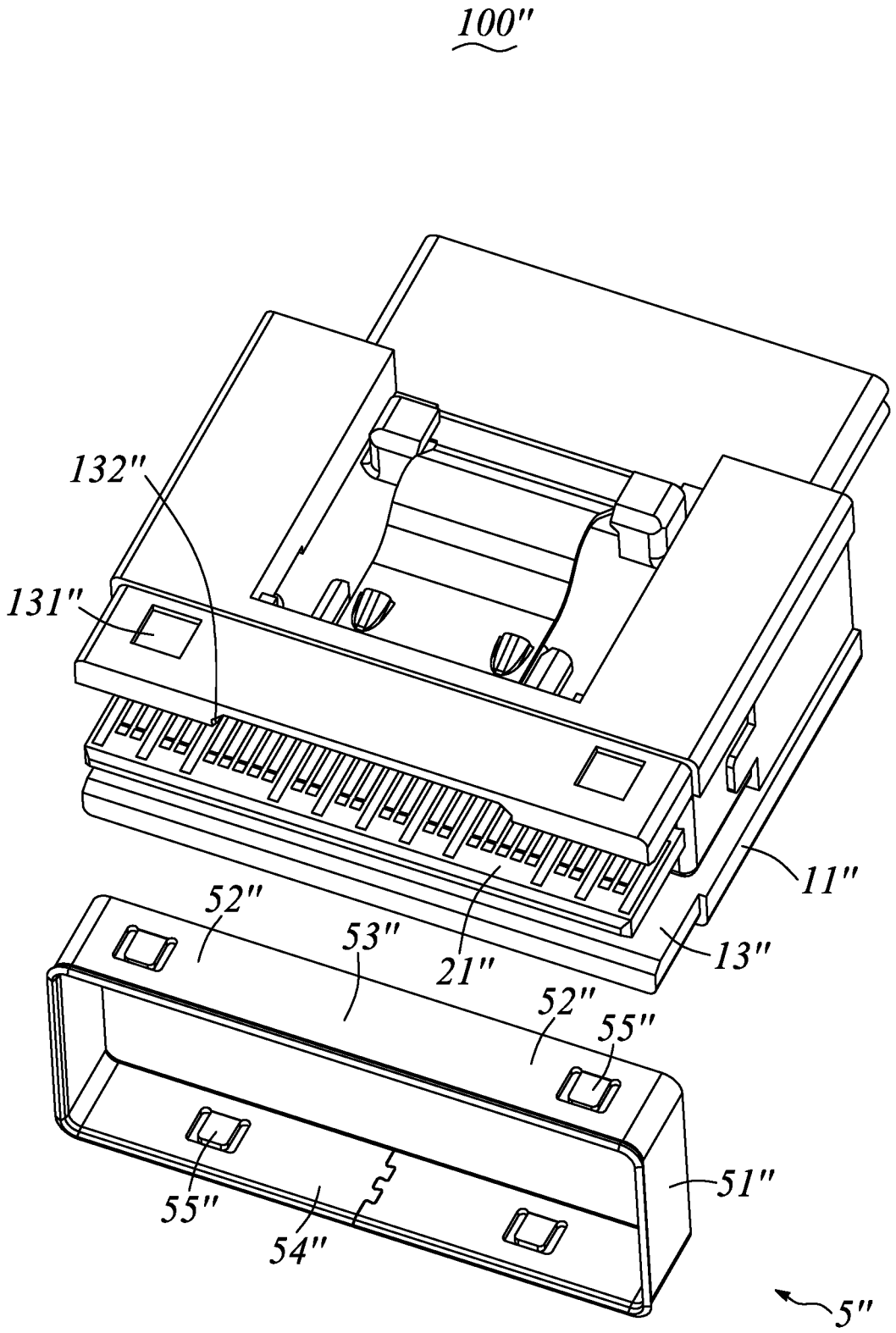
FIG. 13 is a partial exploded view of the electrical connector shown in FIG. 12.
Figure 14:
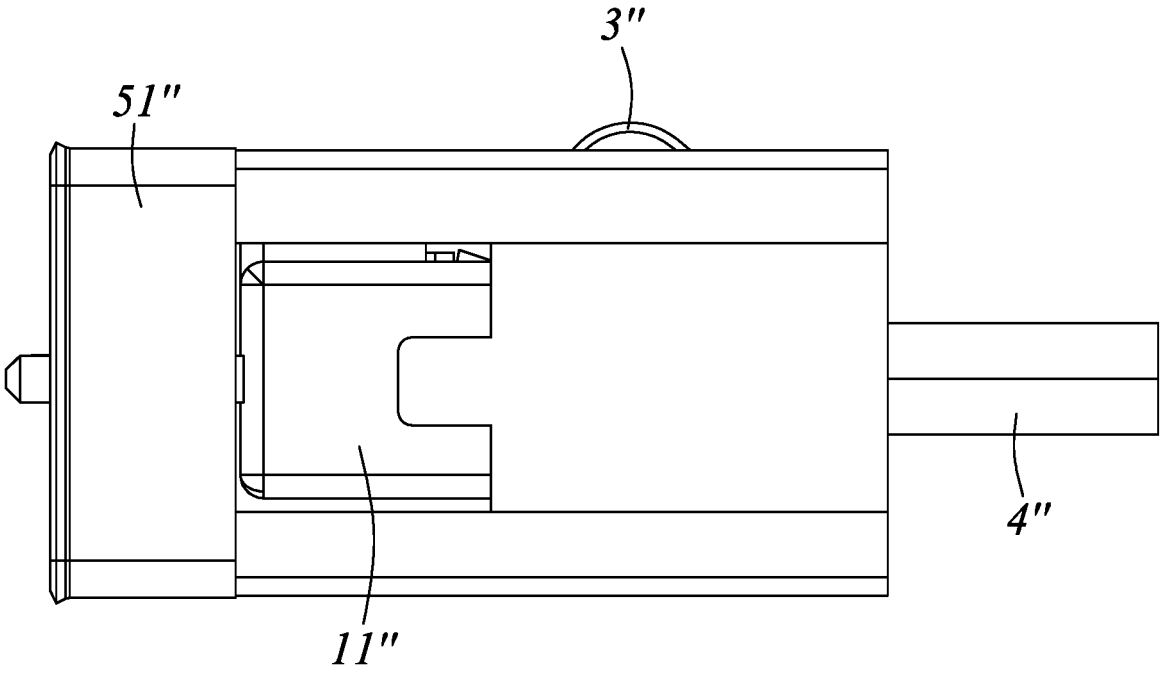
FIG. 14 is a side view of the electrical connector shown in FIG. 13.
Figure 15:
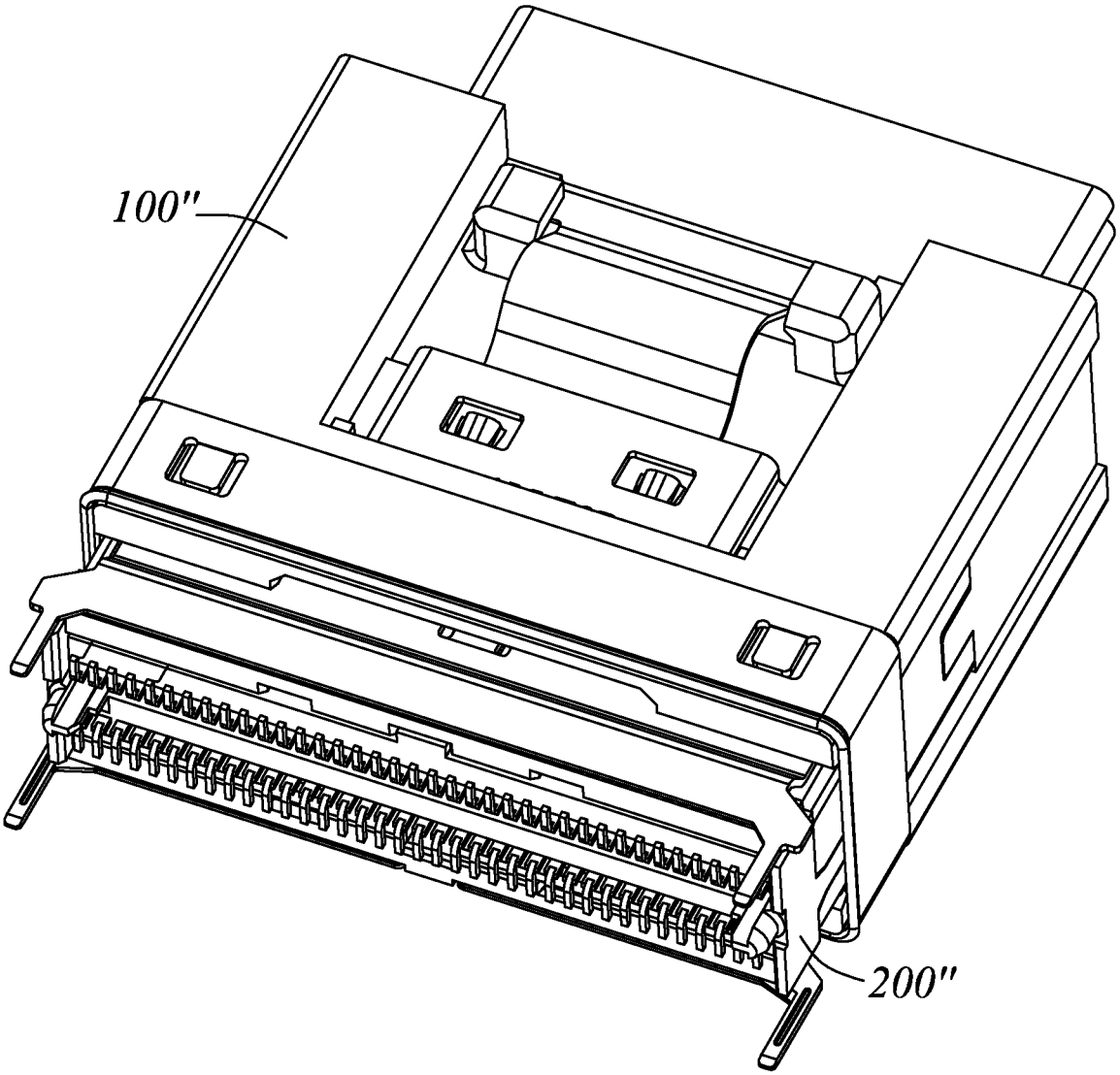
FIG. 15 is a perspective view of the electrical connector in FIG. 12 mating with a complementary connector.

As shown in FIG. 11, in this embodiment, the tongue portion 21' extends forwards beyond a front face of the second limiting plates 52'.

Referring to FIGS. 12 to 15, an insulative housing 1", a printed circuit board 2", a metallic latch 3" and a data transmission cable 4" of an electrical connector 100" in the third embodiment of the present invention are similar or same as that of the first embodiment, so the description for them is omitted here for the third embodiment. The difference is as follows: A pair of extension portions 13" are integrally extending forwards from a mating portion 11" and opposite to each other along a height direction, and a tongue portion 21" is located between the extension portions 13" in the height direction. The extension portions 13" are shrinking as being compared with the mating portion 11", that is to say, the mating portion 11" has outer faces on the outside of corresponding exterior surfaces of the extension portions 13".

A limiting member 5" is assembled to and enclosing on the extension portions 13", and in this embodiment, the limiting member 5" is a metallic frame with a rectangular shape, and comprises a pair of first limiting plates 51", a pair of second limiting plates 52" on an upper side thereof, a linking portion 53" connected between the second limiting plates 52", and a pair of bonding portion 54" on a lower side thereof. A pair of locking holes 131" are defined in each extension portions 13", and recessed towards the tongue portion 21" from an outer surface of each extension portions 13".

A yielding groove 132" is recessed upwards from a bottom surface of an upper extension portions 13", to facilitate an insertion of a complementary connector 200". The limiting member 5" is located on a periphery of the tongue portion 21", and the pair of second limiting plates 52" are located on both sides of the yielding groove 132".

Furthermore, a retaining portion 55" is arranged on each second limiting plate 52" for locking with the locking holes 131", and each bonding portion 54" has one retaining portion 55" too. Conjunction with FIG. 15, in this embodiment, the complementary connector 200" is mounted on an external circuit board (not shown) along a direction parallel to a mating direction, that is to say, a mounting direction of the complementary connector 200" is perpendicular to the height direction of the electrical connector 100".

Figure 16:
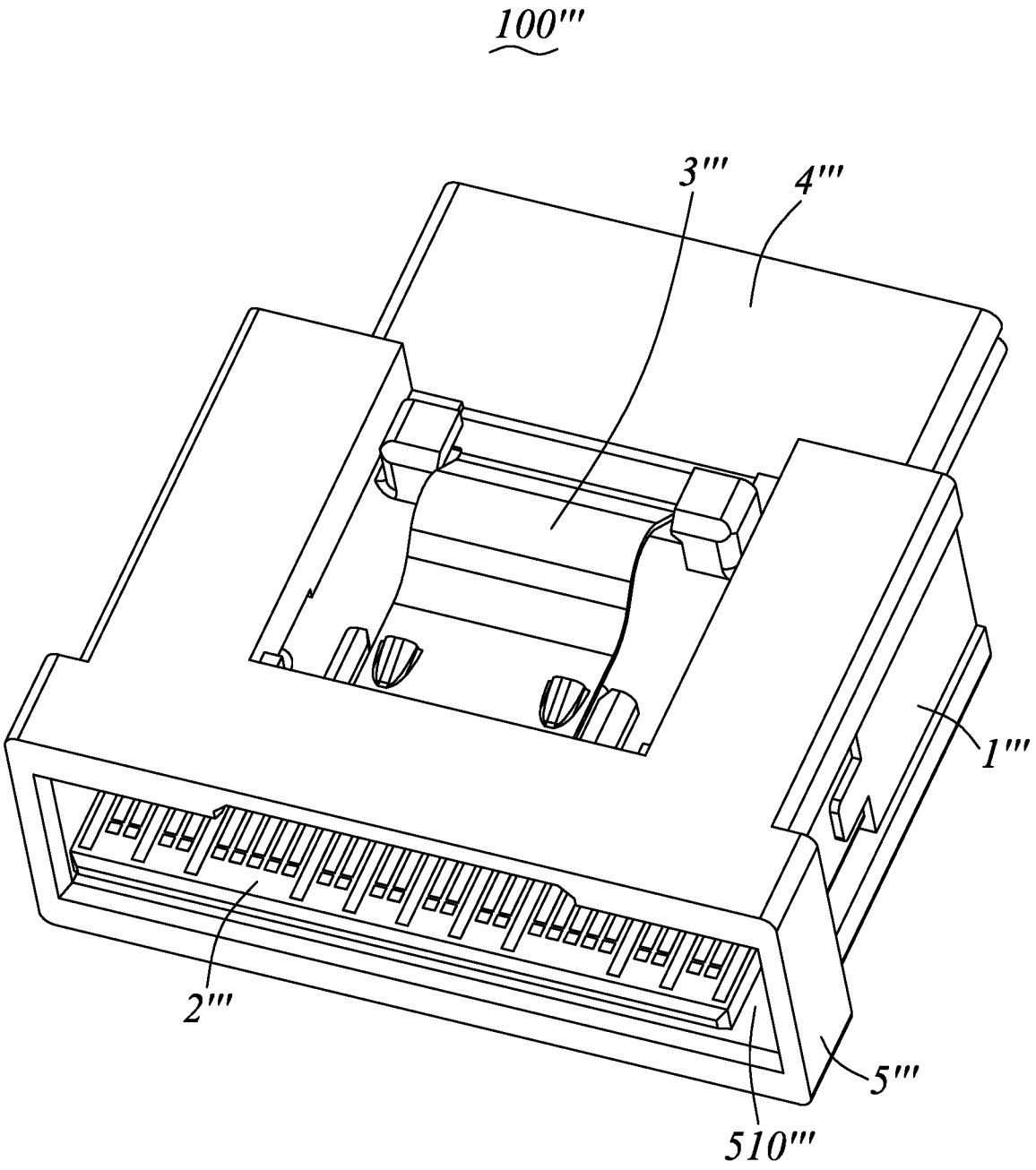
FIG. 16 is an assembled perspective view of an electrical connector in accordance with a fourth embodiment of the present invention.
Figure 17:
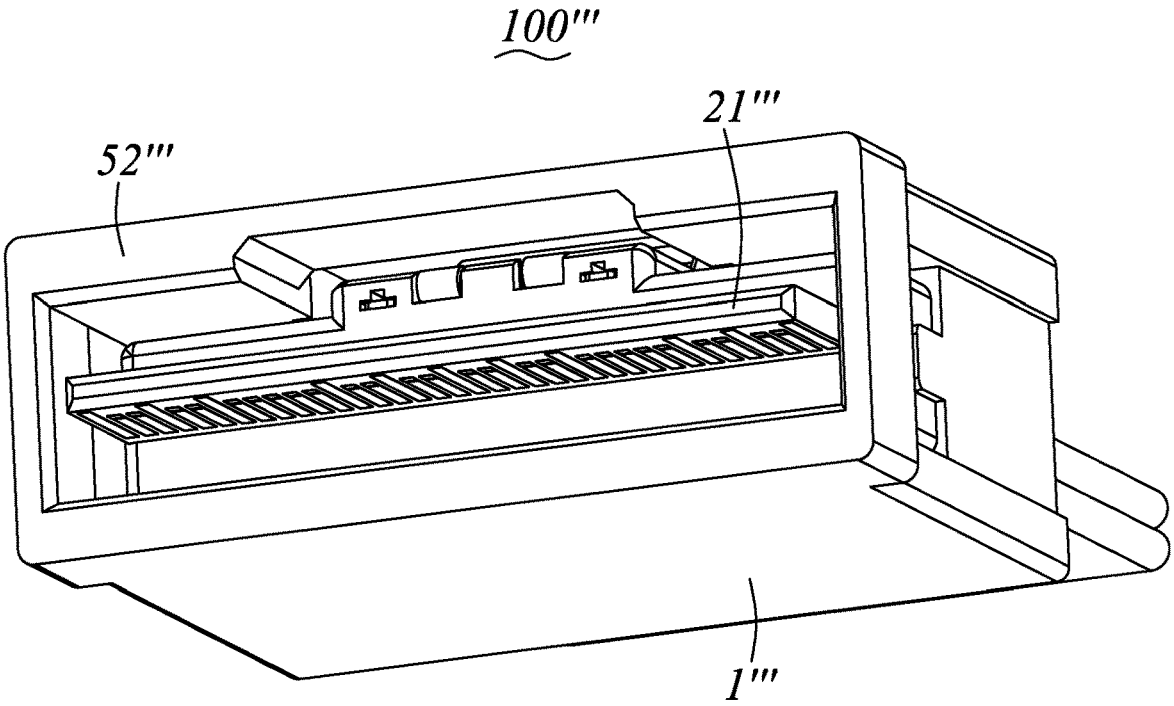
FIGS. 17 to 18 are similar to FIG. 16, but shown from different aspects.
Figure 18:
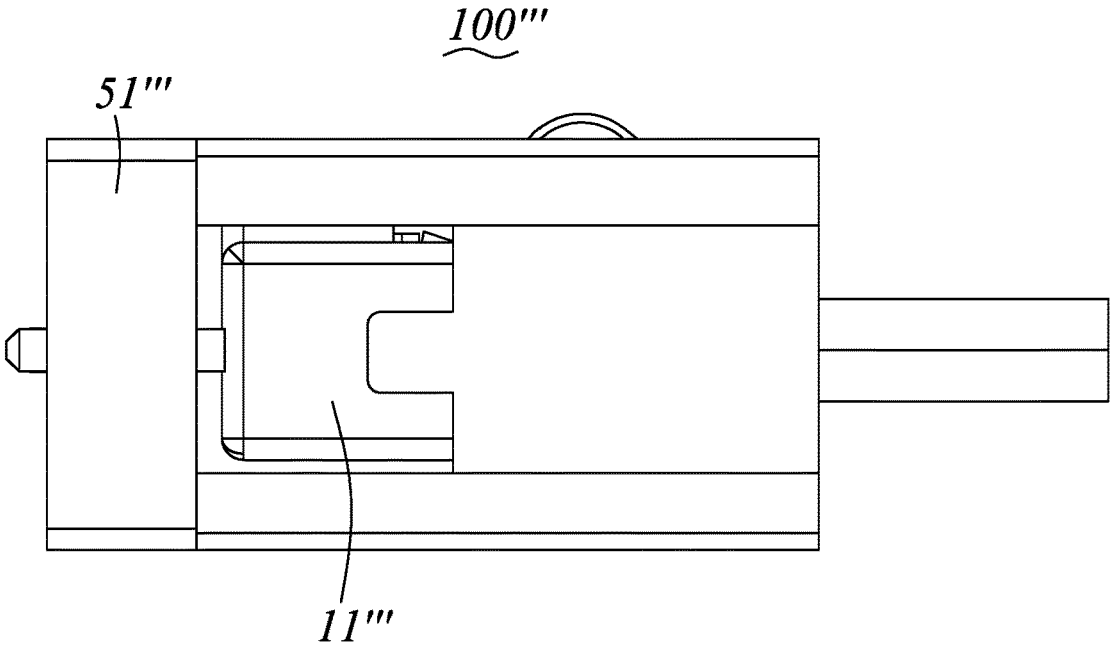

Referring to FIGS. 16 to 18, an insulative housing 1'", a printed circuit board 2'", a metallic latch 3'" and a data transmission cable 4'" of an electrical connector 100'" in the fourth embodiment of the present invention are similar or same as that of the first embodiment, so the description for them is omitted here for the fourth embodiment. The difference is as follows: A limiting member 5'" is surrounding around a tongue portion 21'" and integrally formed with the insulative housing 1'". Similar to the limiting member 5" and the complementary connector 200" in the third embodiment, the limiting member 5'" is of a rectangular frame shape, and the complementary connector (not shown) is mounted on an external circuit board (not shown) along a direction parallel to a mating direction. A pair of first limiting plates 51'" and a pair of second limiting plates 52'" are connected to form the limiting member 5'".

Thus, in the present invention, the first limiting plates 51 (51', 51", 51'") of the limiting member 5 (5', 5", 5'") are located in front of the mating portion 11 (11', 11", 11'") entirely and on both sides of the tongue portion 21 (21', 21", 21'") in a transverse direction, the first guiding slot 510 (510', 510", 510'") is formed between each first limiting plate 51 (51', 51", 51'") and corresponding lateral surface of the tongue portion 21 (21', 21", 21'") in the transverse direction for leading the complementary connector 200 (200") to be plugged.

Furthermore, relative terms, such as "upper" or "top", "lower" or "bottom", "left", "right", "front" and "back", may be used herein to describe one element's relationship to another element as illustrated in the figures. It will be understood that relative terms are intended to encompass different orientations of the device in addition to the orientation depicted in the Figures, and thus shall not be understood as a limitation to the present invention. In addition, term "horizontal" is merely used for description and shall not be understood as equal to along the direction perpendicular to gravity, but allowing for a certain angle of slant.

The above embodiments are only intended for illustrating rather than limiting the technical solutions according to the present invention. Although the present invention is described in detail with reference to the preferred embodiments, it should be understood by those ordinary skilled in the art that the technical solutions according to the present invention can be modified or equivalently substituted without departing from the spirit and scope of the technical solutions.

What is claimed is:

1. An electrical connector, comprising:

an insulative housing having a mating portion and a main portion extending backwards from the mating portion;

a printed circuit board retained in the insulative housing, and having a tongue portion exposed in front of the mating portion and a plurality of golden fingers disposed on the tongue portion for mating with a complementary connector; and a limiting member defining a pair of first limiting plates parallel and opposite to each other;

wherein the first limiting plates are located in front of the mating portion entirely and on both sides of the tongue portion in a transverse direction, a first guiding slot is formed between each first limiting plate and corresponding lateral surface of the tongue portion in the transverse direction for leading the complementary connector to be plugged, the limiting member further has at least one second limiting plate connecting with the first limiting plates, and the second limiting plate covers an upper surface of the tongue portion partially, and a second guiding slot is formed between each second limiting plate and the upper surface of the tongue portion;

wherein the limiting member has two second limiting plates, and each first limiting plate extends downwards from outer sides of the relative second limiting plates and perpendicular to the second limiting plates; and wherein the limiting member is assembled to a pair of extension portions of the insulative housing, and the extension portions are opposite to each other along a height direction or the transverse direction, and integrally extending forwards from the mating portion or the main portion.

2. The electrical connector as claimed in claim 1, wherein a projection of the tongue portion on a vertical plane is at least mostly overlapped with that of the first limiting plate.

3. The electrical connector as claimed in claim 1, wherein an upper surface of the limiting member is approximately coplanar with an uppermost surface of the main portion.

4. The electrical connector as claimed in claim 1, wherein the limiting member is made of metallic material and fully shielding the tongue portion from three sides.

5. The electrical connector as claimed in claim 1, wherein the first limiting plates extend forwards to make a front face thereof at least in front of a front tip end of the tongue portion.

6. The electrical connector as claimed in claim 5, wherein each first limiting plate is vertical to the tongue portion and extending along the height direction, and each first limiting plate has a planar leading face.

7. The electrical connector as claimed in claim 6, wherein each extension portion is provided with a connecting portion extending forwards from the main portion and a pair of arms extending forwards from the connecting portion, two arms of one extension portion are spaced apart from each other in the height direction to form a receiving channel therebetween, and each second limiting plate is fixed in the relative receiving channel and sandwiched by the corresponding pair of arms.

8. The electrical connector as claimed in claim 7, wherein a linking portion is formed between the pair of second limiting plates in the transverse direction, each second limiting plate has a recessed surface on a top side thereof, and the recessed surface is lower than an upper surface of the linking portion.

9. The electrical connector as claimed in claim 1, wherein the limiting member is assembled to and enclosing on the extension portions, a pair of locking holes are defined in each extension portions for locking with the corresponding retaining portions on the limiting member.

10. The electrical connector as claimed in claim 9, wherein the limiting member is of a rectangular frame shape.

11. The electrical connector as claimed in claim 1, further comprising a metallic latch, wherein the metallic latch has a flake-like fixing plate and an elastic plate extending backwards from the fixing plate reversely, the fixing plate is provided with a pair of inserting arms in the front thereof for inserting into the corresponding engaging holes of the insulative housing.

12. The electrical connector as claimed in claim 11, wherein the elastic plate defines a front base portion, a rear supporting beam retaining with the insulative housing, and a pressing portion located between the base portion and the supporting beam.

13. The electrical connector as claimed in claim 12, wherein the supporting beam has a pair of wings on opposite sides thereof in the transverse direction, and the wings are exposed on both sides of the pressing portion and inserted into corresponding receiving slots of the insulative housing.

14. An electrical connector assembly, comprising:

an electrical connector having an insulative housing, a printed circuit board and a limiting member, the insulative housing having a mating portion and a main portion extending backwards from the mating portion, the printed circuit board defining a tongue portion exposed in front of the mating portion and a plurality of golden fingers disposed on the tongue portion, the limiting member having a pair of first limiting plates opposite to each other; and a complementary connector adapted to be mounted to an external circuit board for mating with the golden fingers of the electrical connector;

wherein the first limiting plates are located in front of the mating portion entirely and on both sides of the tongue portion in a transverse direction, a first guiding slot is formed between each first limiting plate and corresponding lateral surface of the tongue portion in the transverse direction for leading the complementary connector to be plugged, the limiting member further has at least one second limiting plate connecting with the first limiting plates, and the second limiting plate covers an upper surface of the tongue portion partially, and a second guiding slot is formed between each second limiting plate and the upper surface of the tongue portion; and wherein the limiting member is integrally formed with the insulative housing, and a pair of linking portions are extending forwards from a main portion of the insulative housing, a pair of second limiting plates are extending forwards from front ends of relative linking portions, the first limiting plates are extending downwards from outer sides of the relative second limiting plates.

15. The electrical connector assembly as claimed in claim 14, wherein the complementary connector is mounted on the external circuit board along a direction vertical to a mating direction.

16. The electrical connector assembly as claimed in claim 14, wherein the complementary connector is mounted on the external circuit board along a direction parallel to a mating direction.

17. An electrical connector, comprising:

an insulative housing having a mating portion and a main portion extending backwards from the mating portion;

a printed circuit board retained in the insulative housing, and having a tongue portion exposed in front of the mating portion and a plurality of golden fingers disposed on the tongue portion for mating with a complementary connector;

a limiting member defining a pair of first limiting plates parallel and opposite to each other; and a metallic latch, wherein the metallic latch has a flake-like fixing plate and an elastic plate extending backwards from the fixing plate reversely, the fixing plate is provided with a pair of inserting arms in the front thereof for inserting into the corresponding engaging holes of the insulative housing;

wherein the first limiting plates are located in front of the mating portion entirely and on both sides of the tongue portion in a transverse direction, a first guiding slot is formed between each first limiting plate and corresponding lateral surface of the tongue portion in the transverse direction for leading the complementary connector to be plugged.

* * * * *